US005233127A

United States Patent [19]

Sauvestre et al.

[11] Patent Number: 5,233,127

[45] Date of Patent: Aug. 3, 1993

[54] CARRIER SHELL

[75] Inventors: Gérard Sauvestre; Régis Aumasson; Dominique Dion, all of Bourges, France

[73] Assignee: Giat Industries, Versailles, France

[21] Appl. No.: 964,903

[22] Filed: Oct. 22, 1992

[30] Foreign Application Priority Data

Oct. 22, 1991 [FR] France ..... 91 13001

[51] Int. Cl.[5] ..... F42B 12/58

[52] U.S. Cl. ..... 102/489; 102/357

[58] Field of Search ..... 102/334, 340, 342, 351, 102/357, 393, 489, 505

[56] References Cited

U.S. PATENT DOCUMENTS 2,454,281 11/1948 Hicks ..... 102/489

4,771,696 9/1988 Smolnik .

FOREIGN PATENT DOCUMENTS 0395456 10/1990 European Pat. Off. .

2363077 3/1978 France .

*Primary Examiner*—Harold J. Tudor

*Attorney, Agent, or Firm*—Oliff & Berridge

[57] ABSTRACT

The technical field of the invention is that of carrier artillery shells. The carrier shell according to the invention is intended to transport at least one payload and contains a casing on which is placed at least one spinner band, the casing being closed at one of its ends by a base and at the other by a head inside of which is placed a gas-generating pyrotechnic composition intended to act on a piston at the time the payload is ejected; the shell being characterized in that the means by which the payload is spun by the casing includes lugs provided on an extension of the head and which interact with notches provided on an upper face of the piston, as well as means to cause the piston and the payload itself to spin together. This invention is applicable to mine-dispersing shells.

6 Claims, 4 Drawing Sheets

CARRIER SHELL

BACKGROUND OF THE INVENTION

The field of this invention is that of carrier artillery shells.

Carrier shells are projectiles intended to transport a payload and then release it at a point in the projectiles' trajectory.

The payload can be, for example, an illuminating charge or can consist of a stack of several submunitions.

French patent FR 2 363 077 describes one such type of shell which comprises a casing closed at one of its ends by a base and at the other by a head. A gas-generating pyrotechnic composition is placed inside the head, wherein the composition is ignited by a timer fuse to create gas pressure which acts on a piston. The thrust exerted by the piston on the stack of submunitions causes separation of the base and casing of the projectile, then ejection of the submunitions from the casing.

Such carrier shells are most often gyroscopically stabilized by being g fired from a gun with a rifled barrel. This then raises the problem of how the payload is to be spun by the carrier shell.

U.S. Pat. No. 4,771,696 proposes a carrier shell in which a band placed on the casing causes the latter to be spun by the rifling of the barrel of the weapon. The casing has, on its inside cylindrical surface, radial notches which interact with complementary lugs present on the outside surface of a base. The base contacts the payload by means of a collar having notches arranged in an axial direction which interact with corresponding lugs on the payload. The base is kept in contact with the payload by means of a threaded ring.

This kind of solution is relatively complex, since it requires the creation on the base of notches in radial and axial directions.

In addition, the casing of the carrier shell disclosed in the 696 patent is generally relatively thin in order to allow carriage of a large payload, which limits the depth of the radial notches and therefor their mechanical strength.

Lastly, with the type of configuration disclosed in the 696 patent, gas leaks are possible between the base and the threaded retention ring, making it essential to provide a rear extension which is threaded onto the base and which presses against the rear of the casing.

The rear extension constitutes an additional part which must be manufactured, procured, and installed on the shell, which is detrimental in terms of cost. Moreover, it requires additional machining to allow installation on the base.

The purpose of the present invention is to provide a carrier shell in which the means allowing the payload to be spun are of a simple and low-cost design, while possessing excellent mechanical strength.

The shell proposed by the invention can also be easily adapted to a payload with a different mass, with no alteration in the mechanical strength of the carrier shell.

SUMMARY OF THE INVENTION

The present invention provides a carrier shell for transporting at least one payload, the carrier shell containing a casing closed at one end by a base and closed at the other end by a head; at least one spinner band situated on the casing; an extension of the head, said extension containing lugs; a piston in contact with the extension having an upper face containing notches; the lugs on the extension interacting with the notches on the piston to cause the extension and the piston to spin together; and a means for causing the piston and the payload to spin together; whereby the payload is caused to be spun by the casing. The invention is applicable to mine-dispersing shells.

BRIEF DESCRIPTION OF THE DRAWINGS

A more complete understanding of the present invention can be obtained by reference to the accompanying drawings wherein.

DESCRIPTION OF PREFERRED EMBODIMENTS

According to a particular embodiment of the invention, the means for causing the piston and the payload itself to spin together comprise at least two undercuts present on a lower face of the piston and placed opposite similar undercuts provided on the payload, said undercuts being intended to receive keys which cause the payload and piston to spin together.

In the event that the payload is divided into at least two sub-payloads stacked axially inside the casing, the sub-payload in contact with the piston also has on its lower face undercuts placed opposite similar undercuts provided on the adjacent sub-payload, said undercuts also being intended to receive keys which cause the two sub-payloads to spin together.

Advantageously, the shell comprises a threaded ring screwed into a tapped thread present on the inside surface of the head and contacting the piston.

Figure 1:
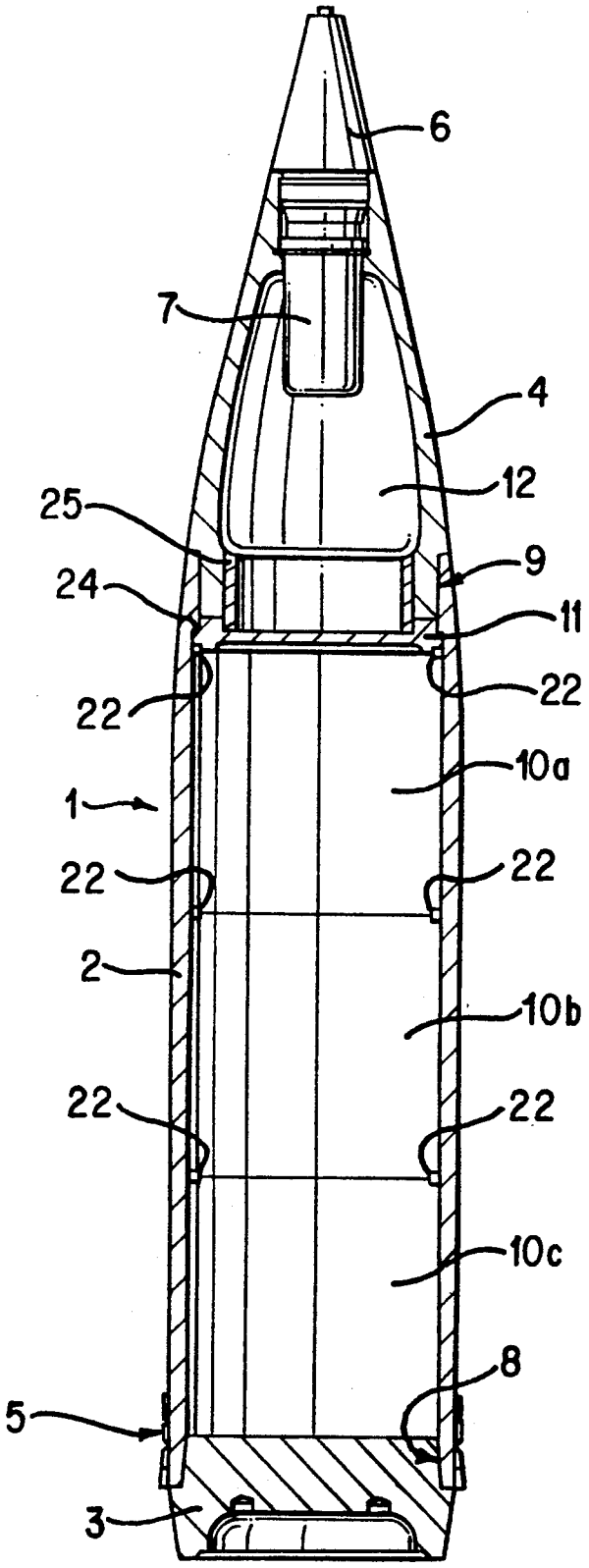
FIG. 1 is a lengthwise sectioned view of a carrier shell according to the invention.

Referring to FIG. 1, a carrier shell 1 contains a cylindrical steel casing 2, attached at one of its ends (called the rear end) to a base 3, and at its other end (called the front end) to a head 4.

The casing has at its rear end a band 5 intended to engage with the rifling of the barrel of a weapon (not depicted) and thus cause the casing to spin.

The band consists of a copper ring welded onto the outside surface of the casing.

The head has a timer fuse 6 of a known type which is mechanically or electronically programmed before the shell is fired by the weapon. When the time thus programmed elapses, said fuse causes ignition of a gas-generating pyrotechnic composition 7.

Base 3 is made integral with casing 2 by means of a thread 8 whose pitch is opposite to that of the rifling in the barrel of the weapon.

Head 4 is attached to casing 2 by a thread 9 whose pitch is identical to that of the rifling in the barrel of the weapon.

In one embodiment of this invention, the casing contains a stack of three sub-payloads 10*a*, 10*b*, 10*c*, which are not described in greater detail and can, for example, be dispersible mines.

Sub-payload 10*c* placed at the rear of the shell rests on base 3 and front sub-payload 10*a* is in contact with a piston 11, middle sub-payload 10*b* being in contact with the other two.

Piston 11 separates the stack of sub-payloads from a cavity 12 inside head 4. The piston is intended to receive the pressure of the gases generated by the combustion of pyrotechnic charge 7.

Figure 2A:
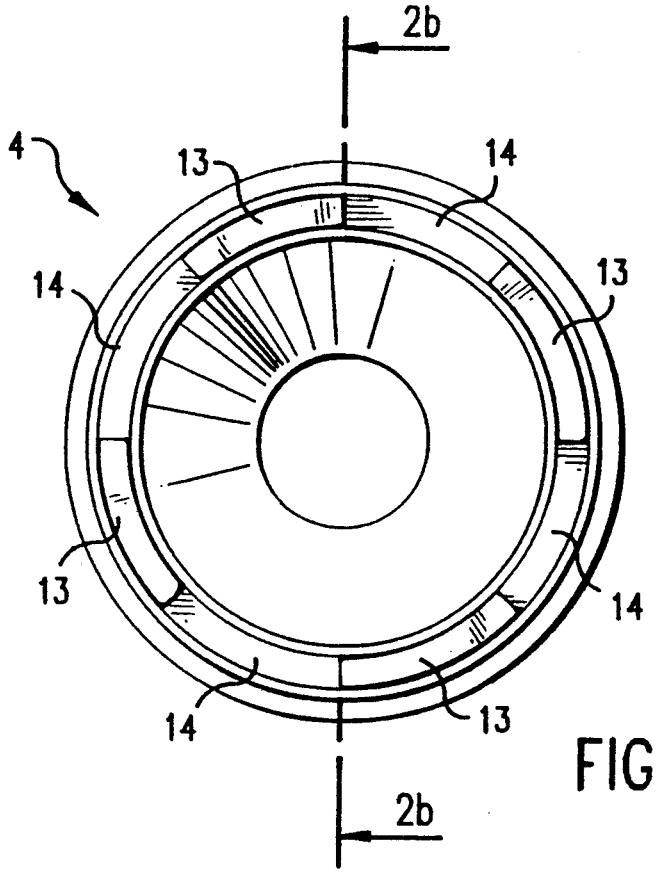
FIGS. 2*a* and 2*b* are views of the head alone, FIG. 2*b* being a view in axial section along plane 2*b*—2*b* of FIG. 2*a;*
Figure 2B:
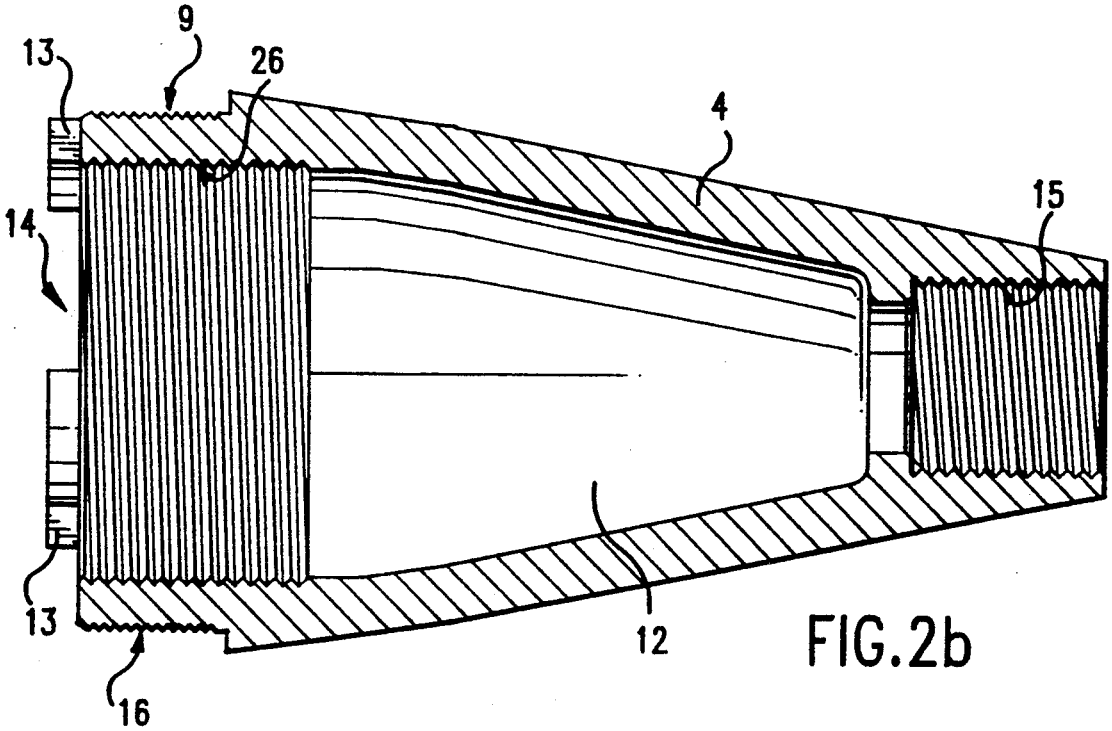

FIGS. 2*a* and 2*b* depict head 4 in more detail. The latter has on its front end a tapped thread 15 intended to receive the timer fuse 6, and on its rear end 4 an extension 16.

Said extension comprises thread 9 by which the head and casing of the shell can be integrated, as well as four lugs 13 distributed at regular angular intervals and separated by notches 14.

Said lugs 13 are intended to cause head 4 and piston 11 to spin together.

The head also has on its inside surface a tapped thread 26 intended to receive a ring 25 (see FIG. 1) whose function will be specified below.

Figure 3A:
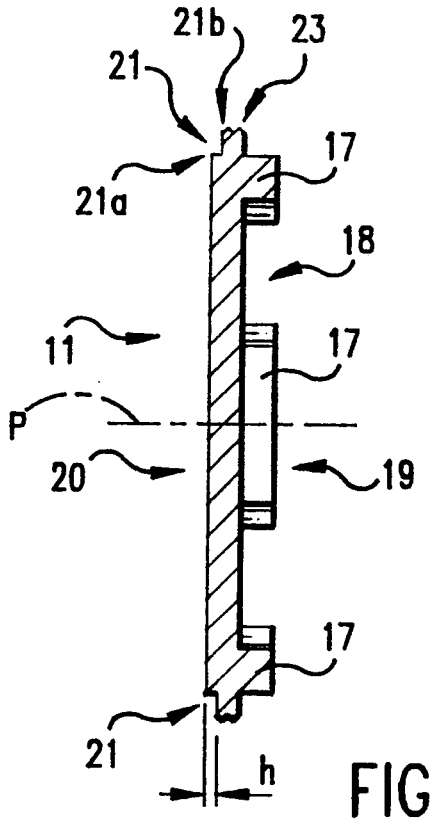
FIG. 3*a* is a view of the piston in axial section along plane 3*a*—3*a* of FIG. 3*c;*
Figure 3B:
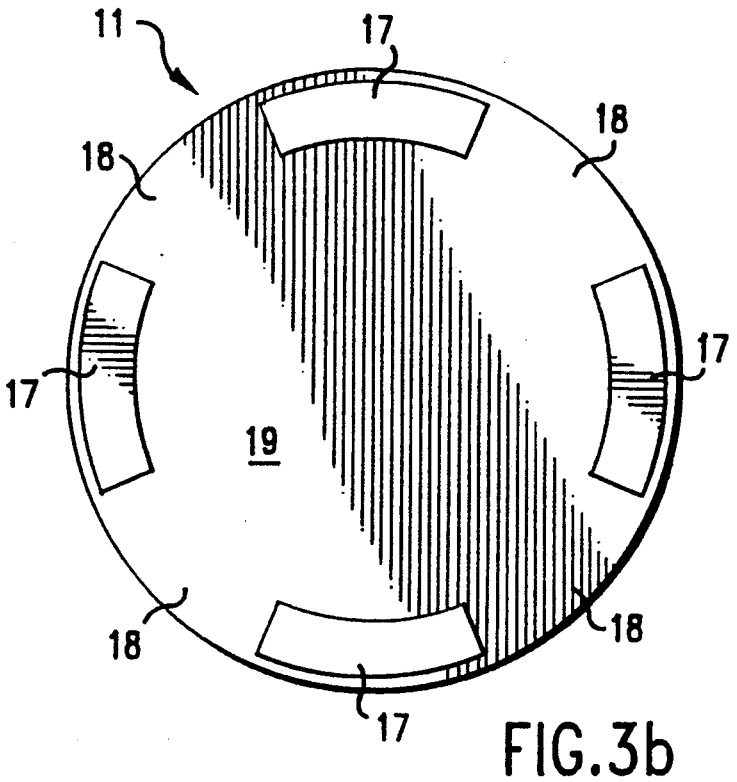
FIGS. 3*b* and 3*c* are two front views of the piston, along its front face and rear face, respectively.
Figure 3C:
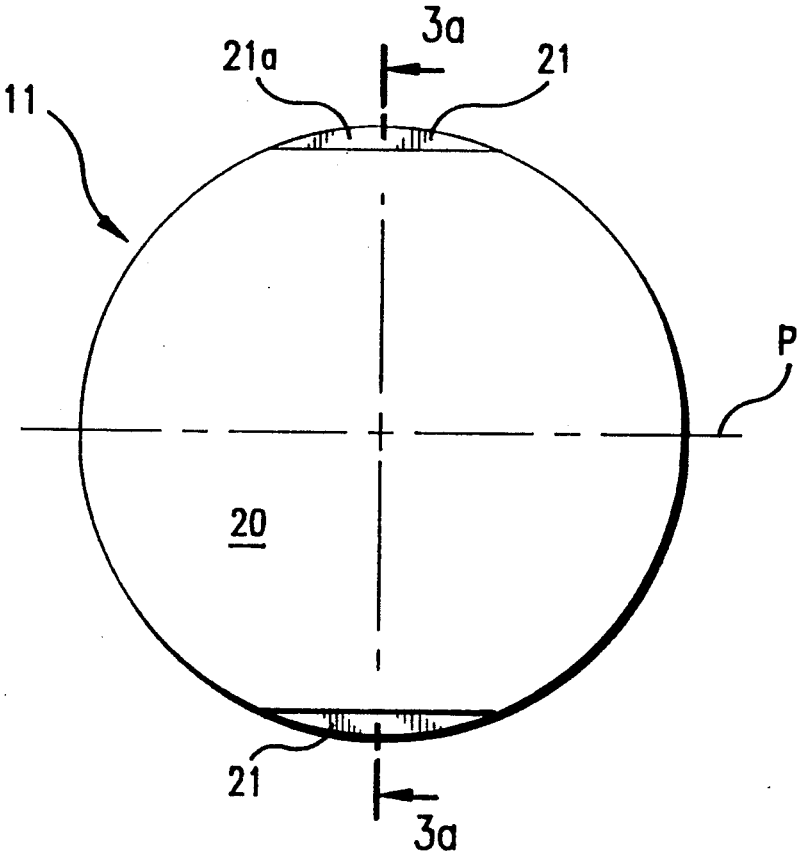

FIGS. 3*a*, 3*b*, and 3*c* depict piston 11 in detail. The latter consists of a cylindrical plate whose outside diameter is substantially equal to the inside diameter of the casing of the shell.

The outside cylindrical surface of piston 11 has a groove 23 which is intended to receive a gasket (not depicted) which will seal against the gases generated by pyrotechnic composition 7.

Front face 19 of piston 11 (depicted in FIG. 3*b*) has four lugs 17 separated by notches 18.

Lugs 17 and notches 18 are intended to interact with lugs 13 and notches 14 present on the head so as to ensure that head 4 and piston 11 spin together.

For this purpose, the widths of notches 18 present on piston 11 must be equal to the widths of lugs 13 present on head 4.

Rear face 20 of piston 11 (shown in FIG. 3*c*) has two undercuts 21 provided at the outside diameter and symmetrically to one another with respect to a radial plane (P) of the piston.

Said undercuts are defined (see FIG. 3*a*) by a plane 21*a* parallel to radial plane P and by a surface 21*b* parallel to rear face 20, and bounded by the outside cylindrical surface of the piston.

The sub-payloads also have, arranged at their front and rear faces, undercuts of the same geometry and the same angular arrangement as those present on the piston.

The undercuts are intended to receive keys 22 which cause front sub-payload 10*a* to be spun by piston 11.

Keys 22 are also placed at the undercuts placed between the various sub-payloads, and thus ensure that middle sub-payload 10*b* is spun by front sub-payload 10*a*, and that rear sub-payload 10*c* is spun by middle sub-payload 10*b*.

Figure 3D:
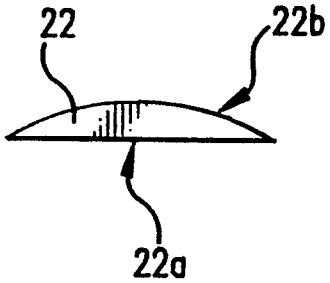
FIGS. 3*d* and 3*e* show, in two views, the key designed to be placed in the undercuts.
Figure 3E:
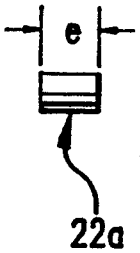

Keys 22 (see FIGS. 3*d* and 3*e*) have a shape complementary to that of undercuts 21 and are thus defined by a flat surface 22*a* and a portion of cylindrical surface 22*b* of diameter substantially equal to the outside diameter of piston 11.

The thickness (e) of the keys is substantially equal to the sum of the depths (h) of the two undercuts within which it is placed (see FIG. 3*a*).

The shell is assembled as follows (see FIG. 1):

Head 4, carrying ring 25, is fastened onto casing 2, ring 25 being placed so that it is entirely inside cavity 12 and is thus recessed with respect to notches 14.

Piston 11 is placed inside the casing so that the lugs of the piston penetrate into the notches of the head.

Two keys 22 are placed in undercuts 21 of piston 11.

Upper sub-payload 10*a* is put in place so that the undercuts on its upper face receive keys 22 placed on the piston.

Two other keys 22 are put in place in the undercuts on the lower face of sub-payload 10*a*.

Middle sub-payload 10*b* is put in place so that the undercuts on its upper face receive keys 22 placed on the lower face of the upper sub-payload.

The keys and lower sub-payload 10*c* are placed similarly.

Base 3 is screwed on.

The total height of the stack is selected so that there is an axial clearance between upper face 19 of piston 11 and threaded ring 25 (FIG. 1).

This clearance is eliminated after assembly by means of threaded ring 25. Said ring is rotated, through the opening in the head intended to receive fuse 6, so that it comes in contact with upper face 19 of piston 11 and causes the stack of sub-payloads to contact the base.

After assembly, a clearance remains between upper face 19 of the piston and a shoulder 24 on the inside surface of casing 2.

A suitable tool will be needed to allow rotation of ring 25 through the opening. Advantageously, notches will be provided on the inside surface of the ring to facilitate driving thereof by means of a tightening tool.

Ring 25 also takes up the axial clearance present when the stack of sub-payloads is assembled.

Obviously the lugs and notches of the head and piston will have depths greater than the axial assembly clearance, so that after the clearance is taken up by the ring, the head and piston can still be effectively caused to spin together.

Thus when the shell is fired, band 5 will cause casing 2 to spin, which in turn will spin head 4 by means of the thread. The head will spin piston 11 by means of the lugs and notches, the piston spinning upper sub-payload 10*a* by means of keys 22 and undercuts 21, and each sub-payload also spinning the adjacent sub-payload by means of keys 22.

The shell according to the invention thus provides integration of the casing and the payload with no need for complex machining of the base, and without reducing the thickness of casing 2 at the base.

The shell according to the invention can easily be adapted for the carriage of payloads of different masses.

Referring to U.S. Pat. No. 4,771,696, if it becomes necessary to design a carrier shell that needs to carry a payload with greater inertia, it is then essential to modify the geometry of the casing itself so as to reinforce the spin lugs of the base.

This might be difficult, given the thinness of the casing and the level of mechanical stress to which it is subjected at the band.

However, with the present invention, it is no longer necessary to modify the geometry of the casing. All that is needed is to modify the length or the section of the lugs carried by the head and the piston. This does not impair the mechanical strength of these elements, since the thickness of the lugs is not limited by the volume of the payload.

What is claimed is:

1. A carrier shell for transporting at least one payload, comprising:

a casing closed at one end by a base and closed at the other end by a head;

at least one spinner band situated on the casing;

an extension of the head, said extension containing lugs;

a piston in contact with the extension having an upper face containing notches, the lugs on the extension interacting with the notches on the piston to cause the extension and the piston to spin together; and means for causing the piston and the payload to spin together;

whereby the payload is caused to be spun by the casing.

2. A carrier shell according to claim 1, further comprising a gas-generating pyrotechnic composition inside the head, for acting on the piston at a time the payload is ejected.

3. A carrier shell according to claim 1, wherein the means for causing the piston and the payload to spin together comprises at least two undercuts present on a lower face of the piston which are adapted to be placed opposite similar undercuts present on the payload, said undercuts being adapted to receive keys which cause the payload and piston to spin together.

4. A carrier shell according to claim 3, further comprising keys to be positioned between the undercuts on the piston and the undercuts on the payload.

5. A carrier shell according to claim 1, further comprising a payload, wherein the payload is divided into at least two sub-payloads stacked axially inside the casing, wherein a first sub-payload has an upper surface in contact with the piston and a lower surface containing undercuts, and a second sub-payload has an upper face adjacent to the lower surface of the first sub-payload and containing undercuts situated opposite to the undercuts on the lower surface of the first sub-payload, wherein the undercuts on the first and second sub-payloads are configured to receive keys which cause the first and second sub-payloads to spin together.

6. A carrier shell according to claim 1, further comprising a threaded ring screwed into a tapped thread, the threaded ring being present on an inside surface of the head and in contact with the piston.

* * * * *